US011672347B1

(12) United States Patent
Wu

(10) Patent No.: US 11,672,347 B1
(45) Date of Patent: Jun. 13, 2023

(54) CHAIR BACK AND SEAT ASSEMBLY

(71) Applicant: COMFORDY CO., LTD., Tainan (TW)

(72) Inventor: Yu-Ling Wu, Tainan (TW)

(73) Assignee: Comfordy Co., Ltd., Tainan (TW)

( * ) Notice: Subject to any disclaimer, the term of this patent is extended or adjusted under 35 U.S.C. 154(b) by 12 days.

(21) Appl. No.: 17/577,667

(22) Filed: Jan. 18, 2022

(51) Int. Cl.
*A47C 7/42* (2006.01)

(52) U.S. Cl.
CPC ..... *A47C 7/42* (2013.01)

(58) Field of Classification Search
CPC ..... A47C 7/42; A47C 7/546
See application file for complete search history.

(56) References Cited

U.S. PATENT DOCUMENTS

| | | | | | |
|---|---|---|---|---|---|
| 5,462,338 | A * | 10/1995 | Baumann | A47C 1/03 403/109.5 |
| 5,615,926 | A * | 4/1997 | Kanai | A47C 7/546 297/411.27 |
| 5,944,387 | A * | 8/1999 | Stumpf | A47C 1/03 297/411.37 |
| 8,104,838 | B2 * | 1/2012 | Tsai | A47C 1/0307 297/383 |
| 8,449,035 | B2 * | 5/2013 | Breitkreuz | A47C 7/42 297/383 |
| 9,578,971 | B2 * | 2/2017 | Su | A47C 1/03 |
| 11,213,132 | B1 * | 1/2022 | Wu | A47C 7/42 |
| 2021/0246925 | A1 * | 8/2021 | Slach | A47C 7/42 |
| 2022/0369815 | A1 * | 11/2022 | Bock | A47C 7/42 |

FOREIGN PATENT DOCUMENTS

| | | | | |
|---|---|---|---|---|
| DE | 10312446 | B3 * | 8/2004 | A47C 7/42 |
| EP | 2792276 | A1 * | 10/2014 | A47C 4/022 |
| JP | 10272032 | A * | 10/1998 | A47C 7/42 |
| KR | 200423241 | Y1 * | 8/2006 | |
| KR | 20100012707 | U * | 12/2010 | |
| KR | 20120116141 | A * | 10/2012 | |
| KR | 20210061662 | A * | 5/2021 | |
| WO | WO-2015135632 | A1 * | 9/2015 | A47C 1/032 |

* cited by examiner

*Primary Examiner* — Timothy J Brindley
(74) *Attorney, Agent, or Firm* — Rosenberg, Klein & Lee

(57) ABSTRACT

A chair back and seat assembly is revealed. The assembly includes a seat base having an assembly recess with two long locking hole on two side walls, and a back support which includes a connection portion on one end and a driving member at the connection portion and connected with locking bars of the connection portion. During assembly, a pull plate of the driving member is pushed by a recess opening of the assembly recess when the connection portion of the back support is mounted into the recess opening of the assembly recess. Thus the driving member is moved backward and driving the two pre-retracted locking bars to be protruding and further locked by the locking holes of the assembly recess. Thereby the assembly is completed easily and conveniently. The design also prevents the seat base and the back support from unexpected loosening while seated.

8 Claims, 14 Drawing Sheets

CHAIR BACK AND SEAT ASSEMBLY

BACKGROUND OF THE INVENTION

Field of the Invention

The present invention relates to a chair back and seat assembly, especially to a chair back and seat assembly which not only provides easy and convenient assembly of a seat base and a back support, but also prevents the seat base and the back support from unexpected loosening while seated.

Description of Related Art

In order to reduce cost of transportation and storage, a chair back from a seat is usually separated from each other for storage independently by chair manufactures. After being delivered to sales locations, the chair back and the seat are assembled again. However, during the assembly of the chair back with the seat, staff need to hold the chair back with one hand and insert screws through holes at a seat base and one end of a back support with other hand. Then a screwdriver is used to drive the screws into the holes one by one to connect the chair back and the seat. The assembly is a labor-intensive and time-consuming task. Moreover, after seated for a period of time, the screws on the seat base and the back support may become loose or even come off due to repeated leaning back and shaking while seated on chairs. The chair has safety problems and fall hazards.

SUMMARY OF THE INVENTION

Therefore, it is a primary object of the present invention to provide a chair back and seat assembly which not only provides easy and convenient assembly of a seat base and a back support, but also prevents the seat base and the back support from unexpected loosening while seated.

In order to achieve the above objects, a chair back and seat assembly according to the present invention mainly includes a seat base and a back support. The seat base is provided with an assembly recess and two long locking holes arranged at two side walls of the assembly recess. The back support includes a connection portion on one end and a driving member which is arranged at the connection portion and connected with locking bars on two sides of the connection portion. During assembly of the chair back with the seat, a pull plate of the driving member is pushed by a recess opening of the assembly recess when the connection portion of the back support is mounted into the recess opening of the assembly recess. Thus the driving member is further moved backward and driving the two pre-retracted locking bars to be released, protruding and further locked by the locking holes of the assembly recess. Thereby the assembly of the seat base and the back support is completed easily and conveniently. The design also prevents the seat base and the back support from unexpected loosening while seated.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
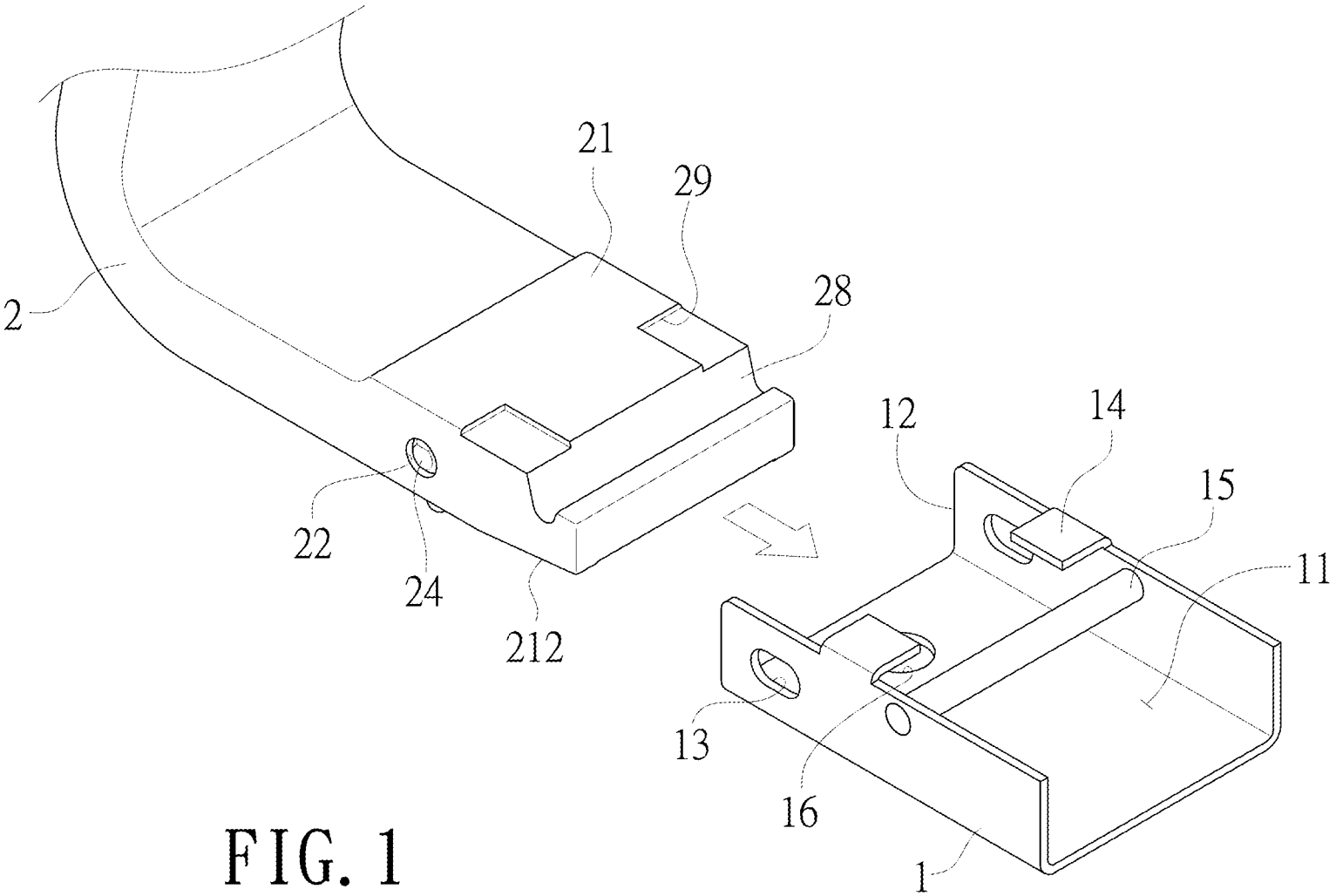
FIG. 1 is an exploded view of an embodiment according to the present invention.

Refer to FIGS. 1-4, a chair back and seat assembly according to the present invention includes a seat base 1 and a back support 2.

A section of the seat base 1 is U-shaped. The seat base 1 is composed of an assembly recess 11, a recess opening 12 formed on a rear end of the assembly recess 11, a long locking hole 13 arranged at each of two opposite side walls of the assembly recess 11, a stopping block 14 extended from a top of each of the two opposite side walls of the assembly recess 11 toward an inner space of the assembly recess 11, a leaning rod 15 disposed transversely over an upper part of the assembly recess 11, and a through hole 16 arranged at a bottom of the assembly recess 11. The locking hole 13 is a long slot and positions of the two locking holes 13 are corresponding to each other and are positions of the two stopping blocks 14. Two ends of the leaning rod 15 are connected to the two opposite side walls of the assembly recess 11 correspondingly.

Figure 2:
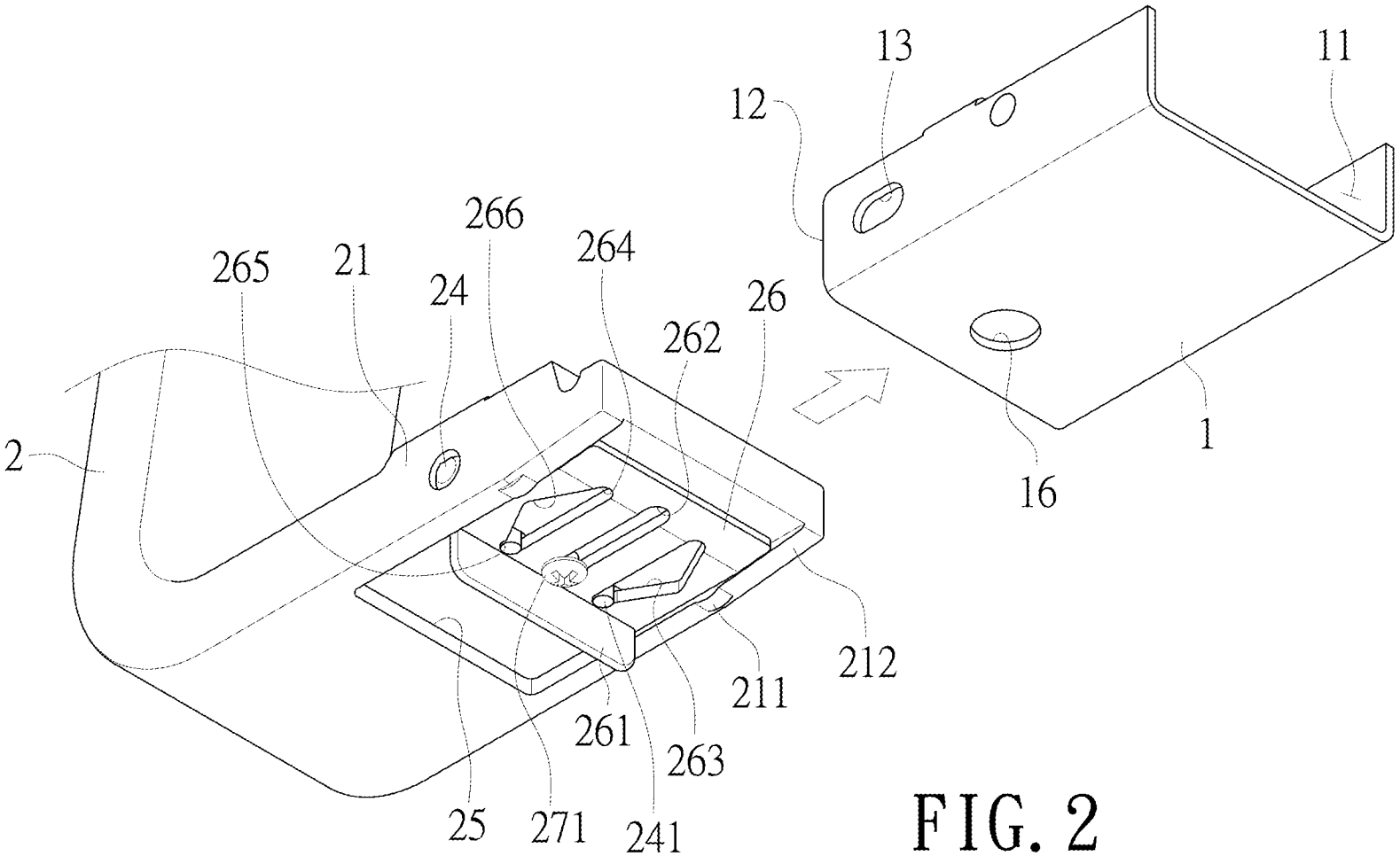
FIG. 2 is another exploded view of an embodiment according to the present invention.
Figure 3:
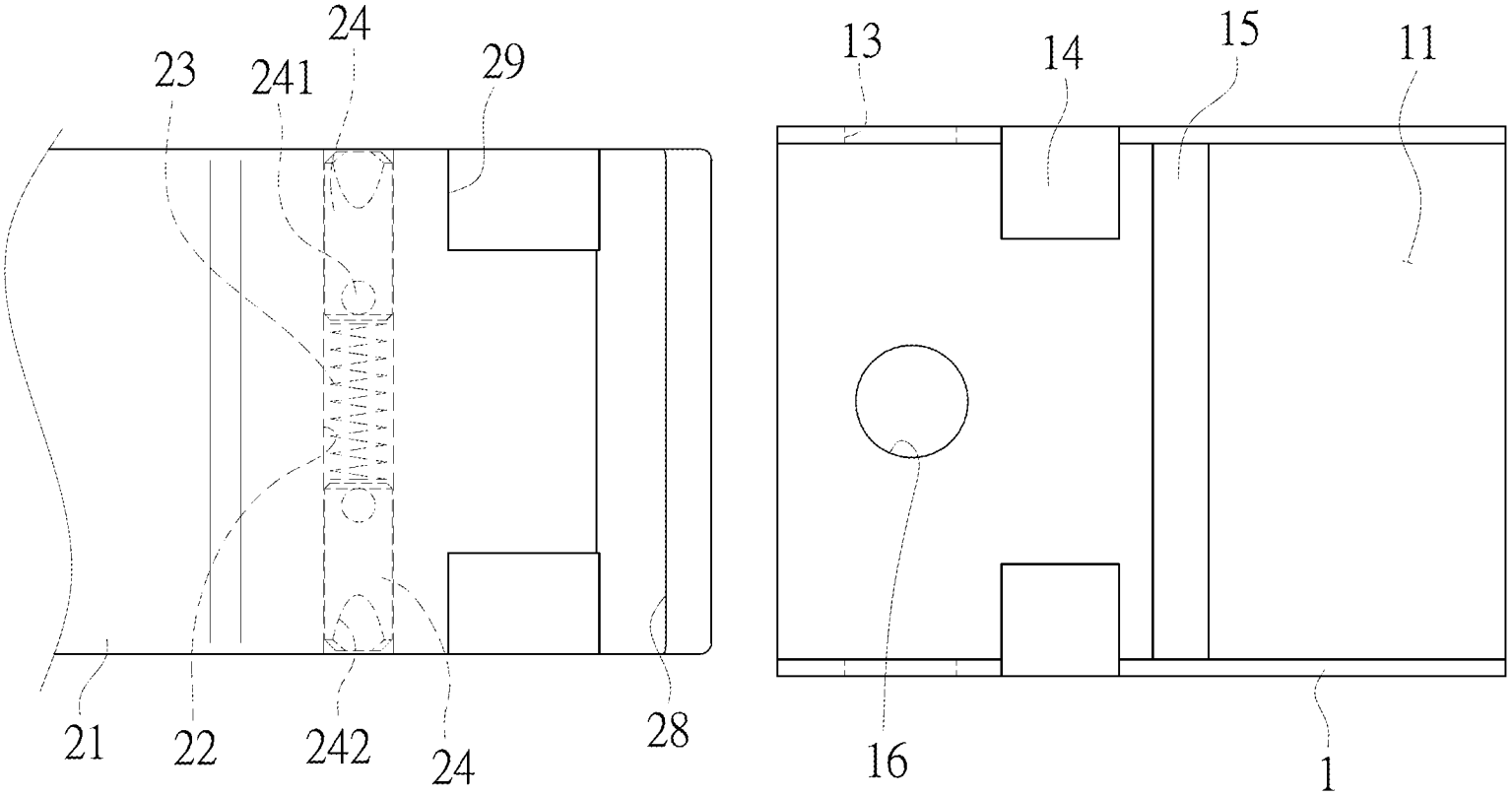
FIG. 3 is a top view of an embodiment according to the present invention.
Figure 4:
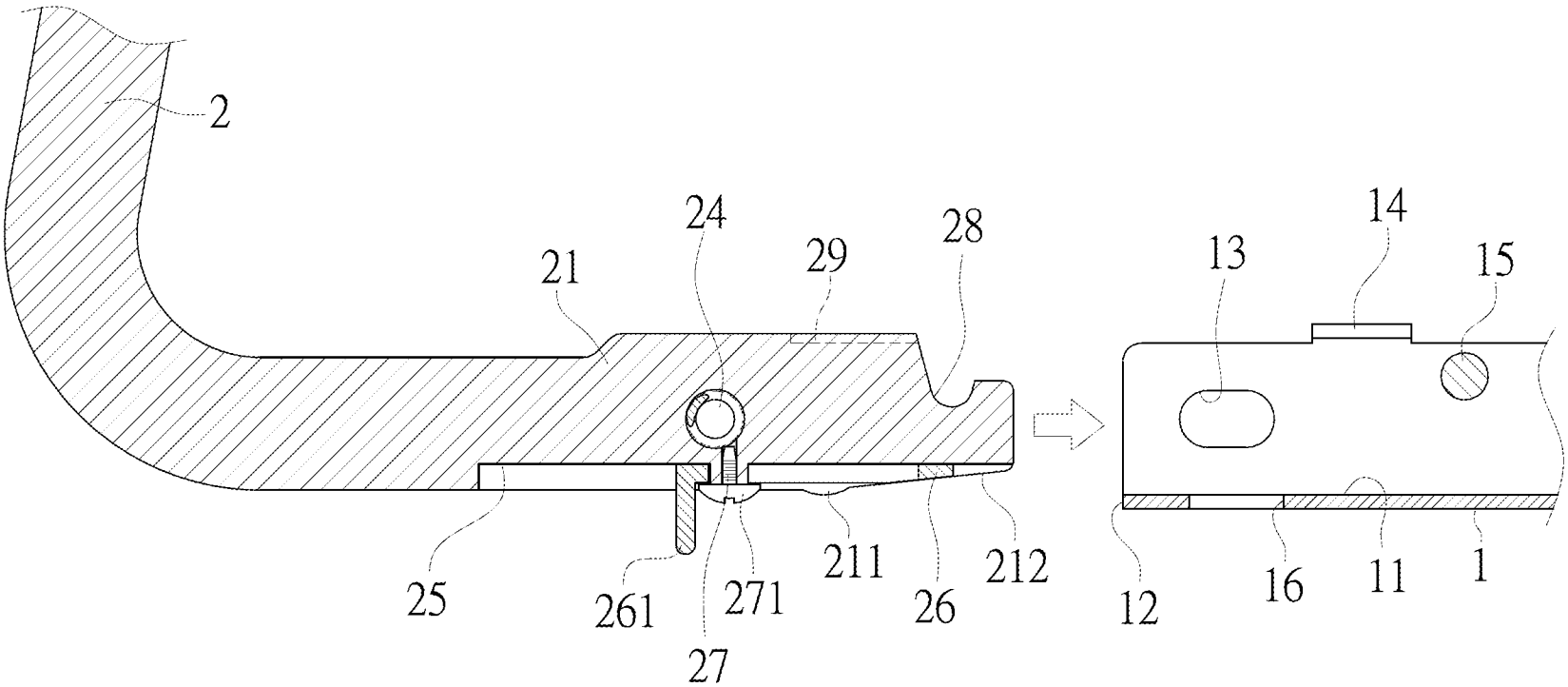
FIG. 4 is a sectional view of an embodiment according to the present invention.
Figure 5:
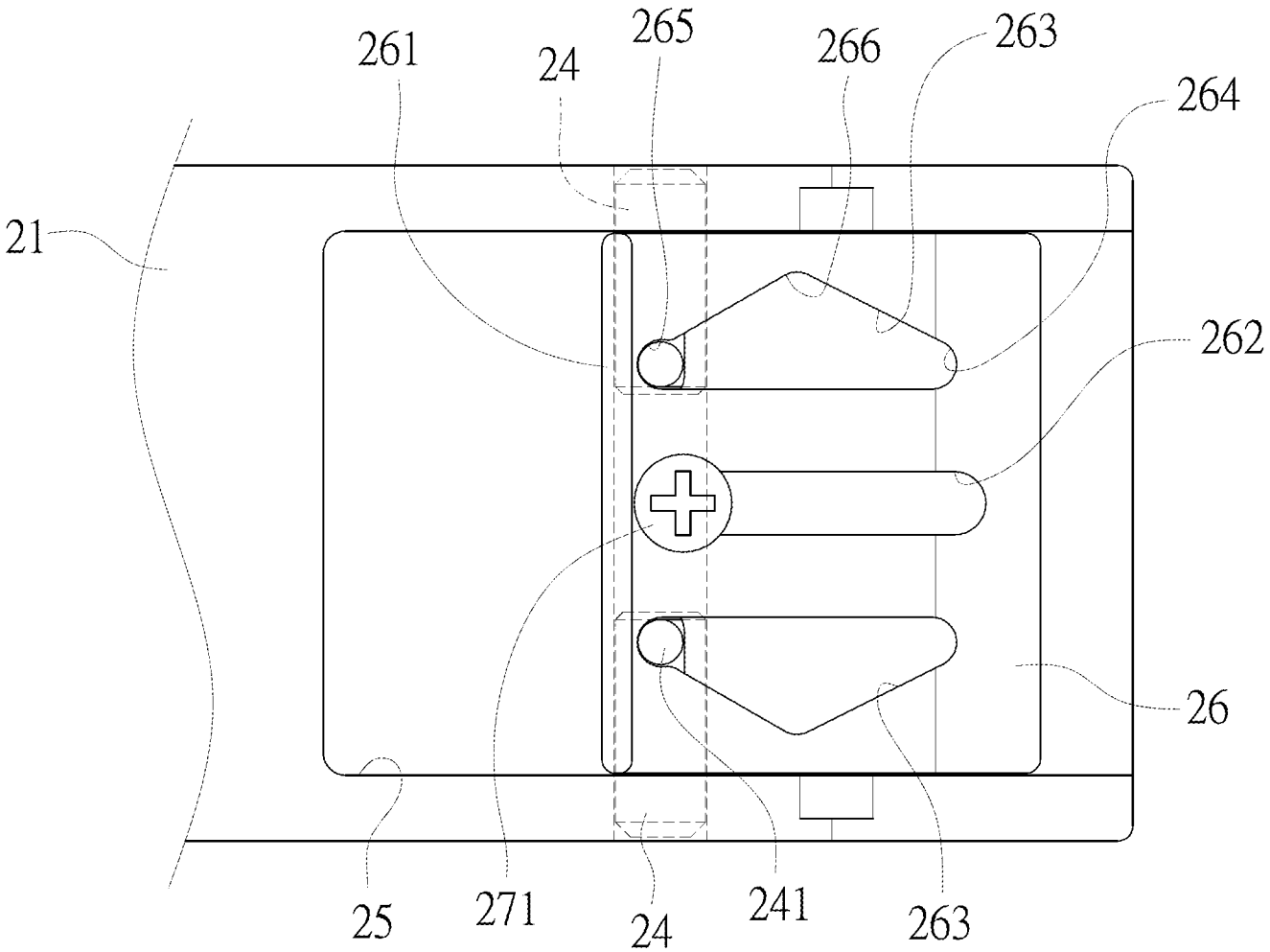
FIG. 5 is a partial bottom view of an embodiment during assembly according to the present invention.
Figure 7:
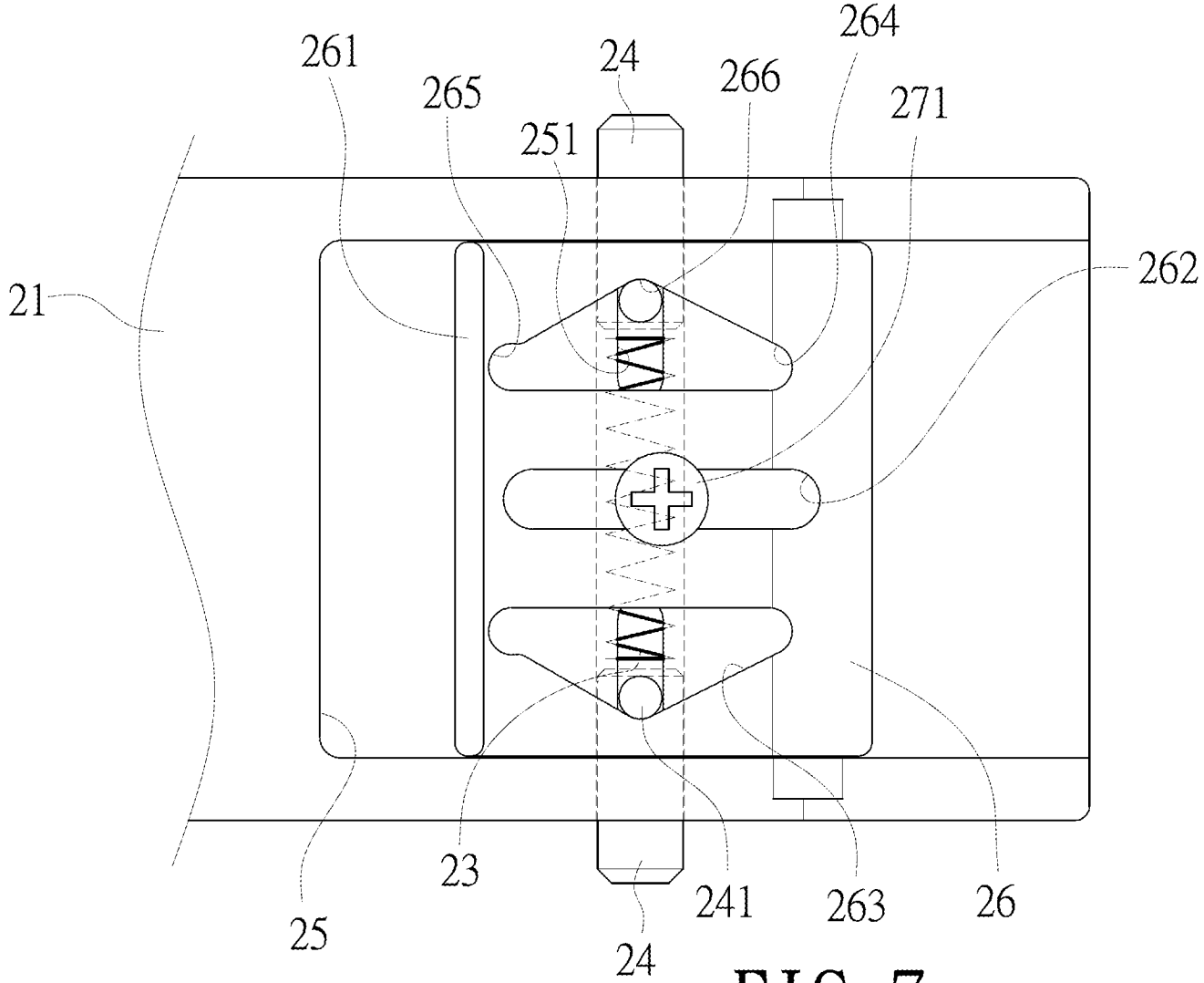
FIG. 7 is another partial bottom view of an embodiment during assembly according to the present invention.

A section of the back support 2 is L-shaped. The back support 2 consists of a connection portion 21 on a rear end thereof, a mounting hole 22 transversely penetrating the connection portion 21, an elastic member 23 mounted in the mounting hole 22, two locking bars 24 mounted in the mounting hole 22 and located at two ends of the elastic member 23 correspondingly, a guiding slot 25, a driving member 26 mounted in the guiding slot 25, a fastener 27, a mounting groove 28, and two concave area 29. The connection portion 21 which includes a top surface and a bottom surface opposite to each other is mounted into the assembly recess 11 of the seat base 1 through the recess opening 12 of the assembly recess 11 while the guiding slot 25 is arranged at the bottom surface of the connection portion 21. The two locking bars 24 are abutting against the two ends of the elastic member 23. As shown in FIG. 2, a bump 211 which is disposed on the bottom surface of the connection portion 21 and located at each of two sides of the guiding slot 25 is abutting against and positioned on a bottom of the assembly recess 11 of the seat base 1. A guiding ramp 212 inclined upward from the bump 211 toward a front end of the connection portion 21 is formed on the bottom surface of the connection portion 21. As shown in FIG. 7, two transverse guiding holes 251 are formed on a top of the guiding slot 25 and communicating with the mounting hole 22 while the locking bar 24 is provided with a cutting surface 242 located on a top side thereof and a pin 241 formed on a bottom side thereof and projecting from the guiding hole 251. As shown in FIG. 5, the driving member 26 is composed of a pull plate 261 formed on a rear end thereof, a lengthwise long slot 262 arranged at a middle portion thereof and extending from a front end to the rear end thereof, and an engaging hole 263 which disposed on each of two sides of the long slot 262 and composed of a first locking-bar binding portion 264, a second locking-bar binding portion 265, and a locking-bar release portion 266. The engaging hole 263 is in a shape of an isosceles triangle having a first end, a second end, and a third end each of which is provided with a rounded corner. The first end and the second end (corresponding to two base angles of the isosceles triangle) on a front end and a rear end of the engaging hole 263 form the first locking-bar binding portion 264 and the second locking-bar binding portion 265 respectively and the third end (corresponding to vertex angle of the isosceles triangle) of the engaging hole 263 between the first locking-bar binding portion 264 and the second locking-bar binding portion 265 forms the locking-bar release portion 266. The pins 241 of the two locking bars 24 are mounted in two the engaging holes 263 correspondingly for control of the locking bars 24 to be engaged with or separated from the locking holes 13 on the respective side walls of the assembly recess 11 of the seat base 1 by the driving member 26. Refer to FIG. 4, the fastener 27 is inserted through the long slot 262 of the driving member 26 to be fastened and connected with the connection portion 21 and a head 271 of the fastener 27 is abutting against a bottom surface of the driving member 26 for positioning. The mounting groove 28 is transversely arranged at the top surface of the connection portion 21 while the two concave area 29 are formed on two sides of the top surface of the connection portion 21 correspondingly. The leaning rod 15 of the seat base 1 is abutting against and positioned by the mounting groove 28 while the stopping block 14 on each of the two sides of the assembly recess 11 is mounted and positioned in the concave area 29 correspondingly.

The staff pull the driving member 26 forward before the present assembly being delivered from the factory. As shown in FIG. 5, the pin 241 of the respective locking bars 24 mounted in the corresponding engaging hole 263 of the driving member 26 is moved from the locking-bar release portion 266 of the engaging hole 263 toward the second locking-bar binding portion 265 at the rear end of the engaging hole 263 of the driving member 26. When the pin 241 of the locking bar 24 is guided by the engaging hole 263 and moved to the second locking-bar binding portion 265 at the rear end, the locking bar 24 is limited and retracted into the mounting hole 22 of the connection portion 21. Now the elastic member 23 located between the two locking bars 24 is compressed.

Figure 6:
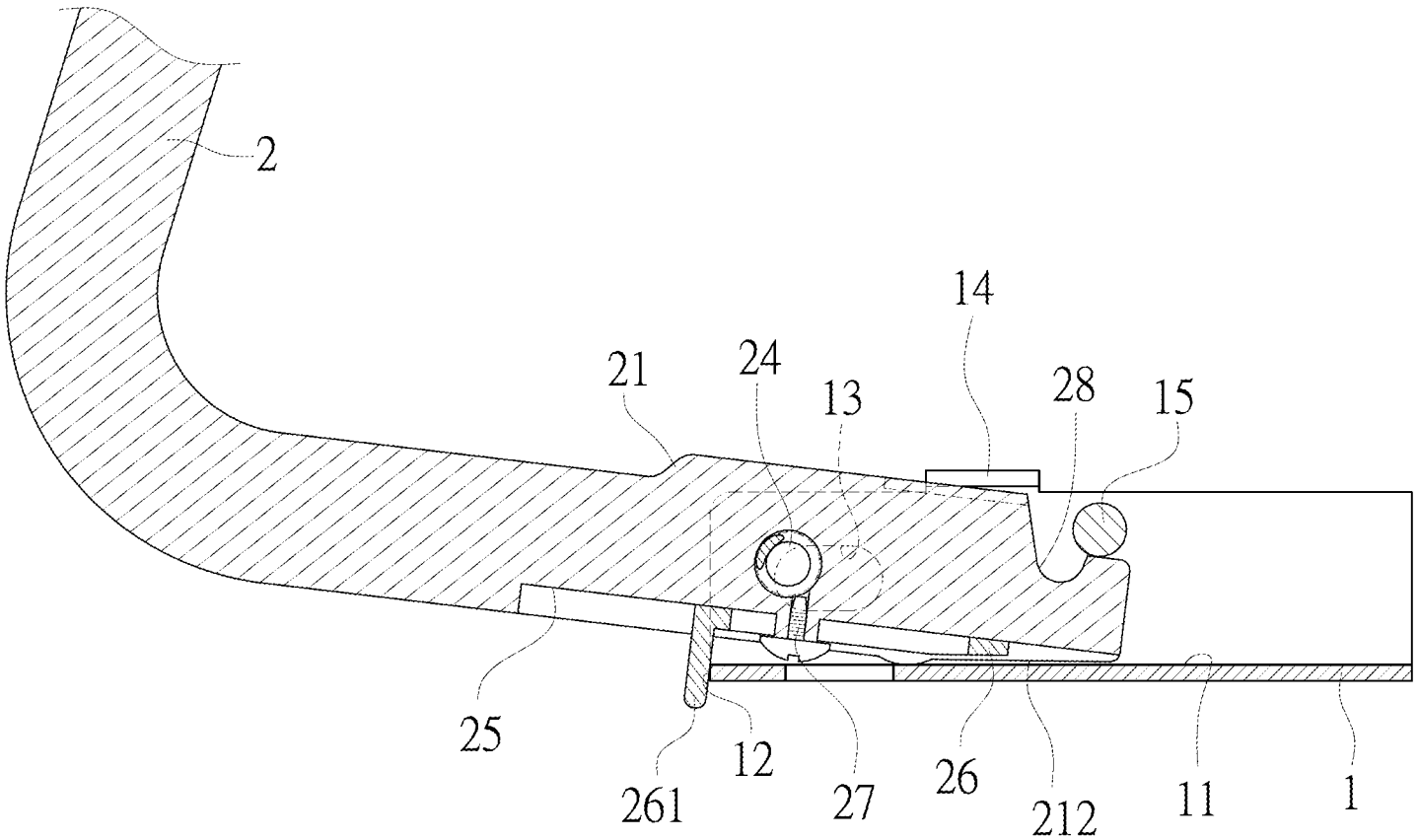
FIG. 6 is a sectional view of an embodiment during assembly according to the present invention.

Refer to FIG. 6, after consumers buy the present assembly and intend to connect the seat base 1 with the back support 2, users hold the back support 2 with two hands to align and mount the connection portion 21 of the back support 2 to the assembly recess 11 of the seat base 1 through the recess opening 12 of the seat base 1. By the design of the guiding ramp 212 on the front end of the connection portion 21, the connection portion 21 is mounted into the assembly recess 11 smoother. Moreover, the stopping blocks 14 on the top of two sides of the assembly recess 11 work together with the bottom of the assembly recess 11 to form a guiding track so that mounting smoothness of the connection portion 21 into the assembly recess 11 is further improved. While the pull plate 261 of the driving member 26 on the bottom surface of the connection portion 21 is abutting against and in contact with the recess opening 12 of the seat base 1, the pull plate 261 of the driving member 26 is pushed backward by the recess opening 12 of the seat base 1 along with the continuous movement of the connection portion 21 into the assembly recess 11 to move the driving member 26 backward and return to its original position.

Figure 8:
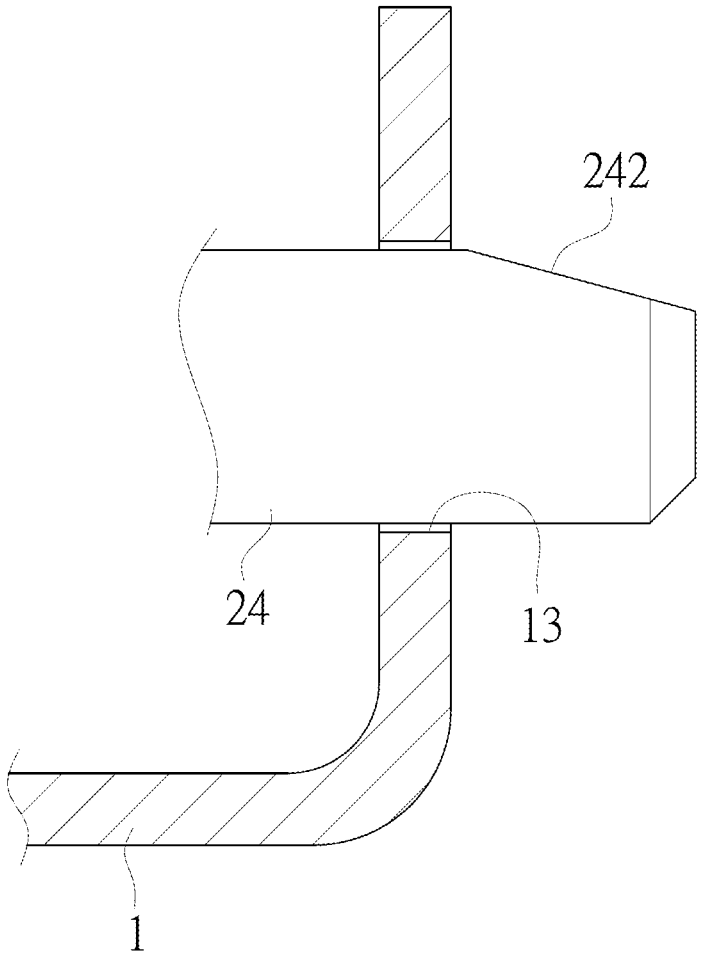
FIG. 8 is a partial enlarged sectional view of an embodiment during assembly according to the present invention.
Figure 9:
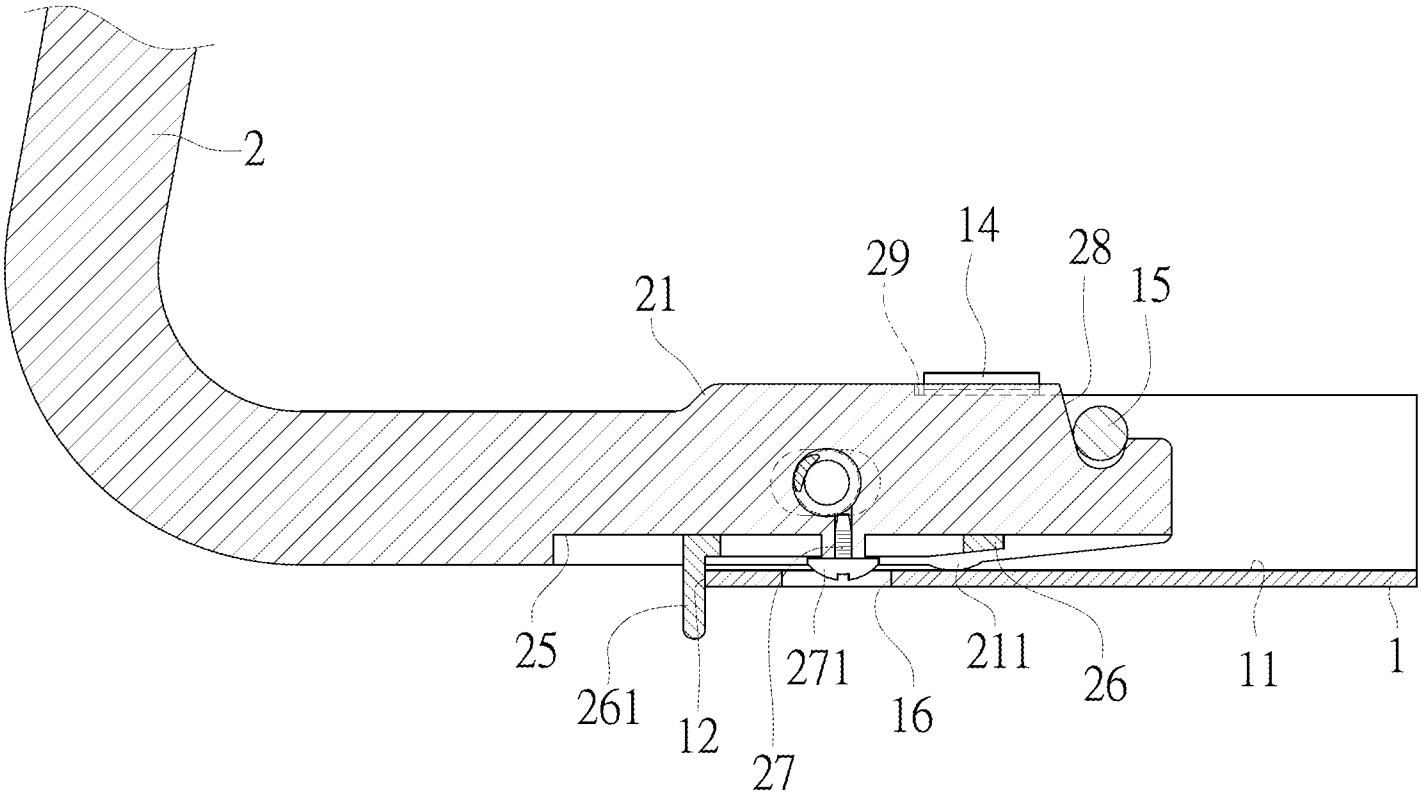
FIG. 9 is another sectional view of an embodiment during assembly according to the present invention.
Figure 10:
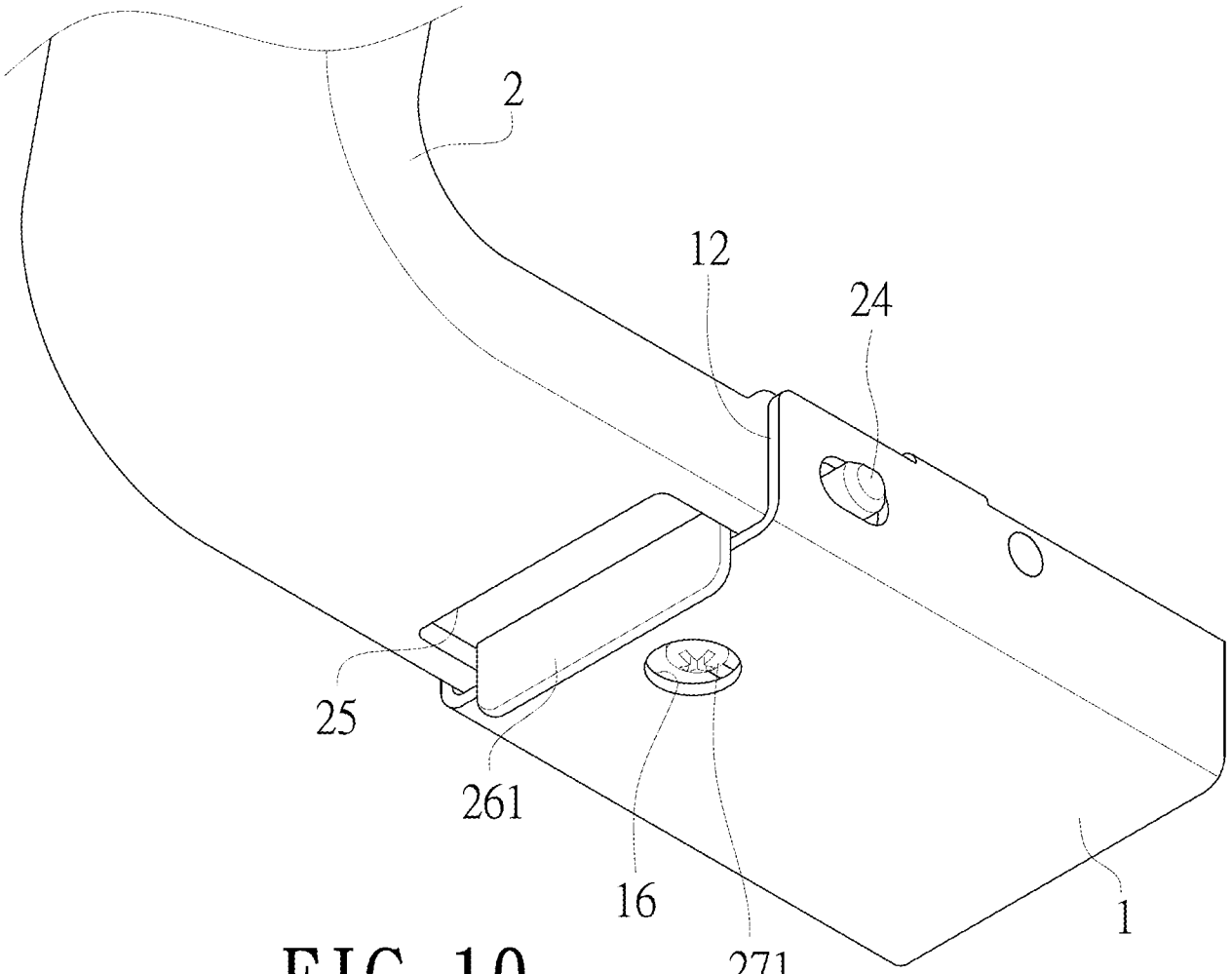
FIG. 10 is a perspective view of an embodiment during assembly according to the present invention.

Also refer to FIG. 7, the pins 241 of the respective locking bars 24 are moved from the second locking-bar binding portion 265 on the rear end of the engaging hole 263 toward the locking-bar release portion 266 under guidance of the engaging hole 263 of the driving member 26. Once the pin 241 reaches the locking-bar release portion 266, the compressed elastic member 23 located between the two locking bars 24 is released. Also refer to FIG. 8, an end portion of the locking bar 24 is further pushed out of the mounting hole 22 of the connection portion 21 to be locked and positioned by the locking hole 13 on each of the two side walls of the assembly recess 11. Under the guidance of the cutting surface 242 on the top side of the locking bar 24, the locking bar 24 is inserted into the locking hole 13 smoother. Also refer to FIG. 9 and FIG. 10, the head 271 of the fastener 27 of the connection portion 21 is located in the through hole 16 on the bottom of the assembly recess 11 correspondingly so that the bottom surface of the connection portion 21 and the bottom of the assembly recess 11 are attached closely. By the bump 211 on the bottom surface of the connection portion 21, tolerance of the assembly recess 11 assembled with the connection portion 21 is reduced so that the assembly recess 11 and the connection portion 21 are connected firmly.

Figure 11:
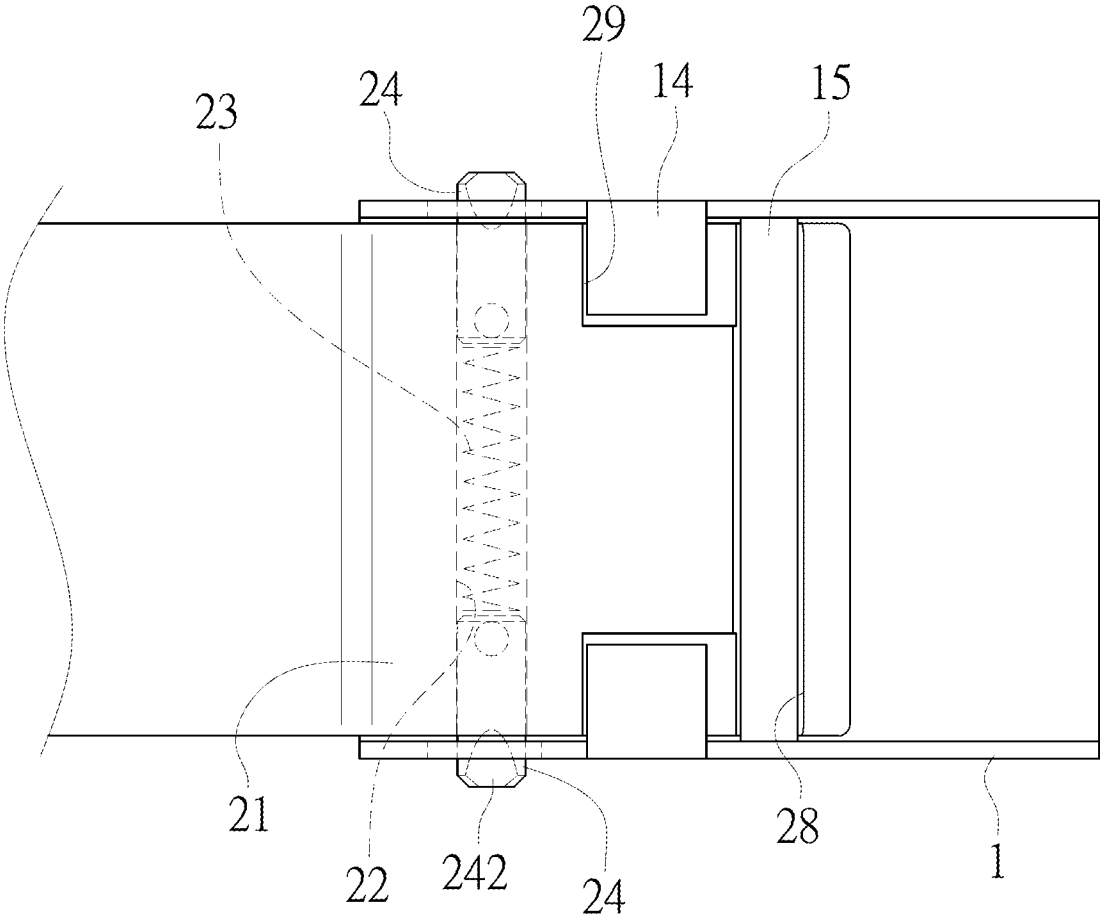
FIG. 11 is a top view of an embodiment during assembly according to the present invention.
Figure 12:
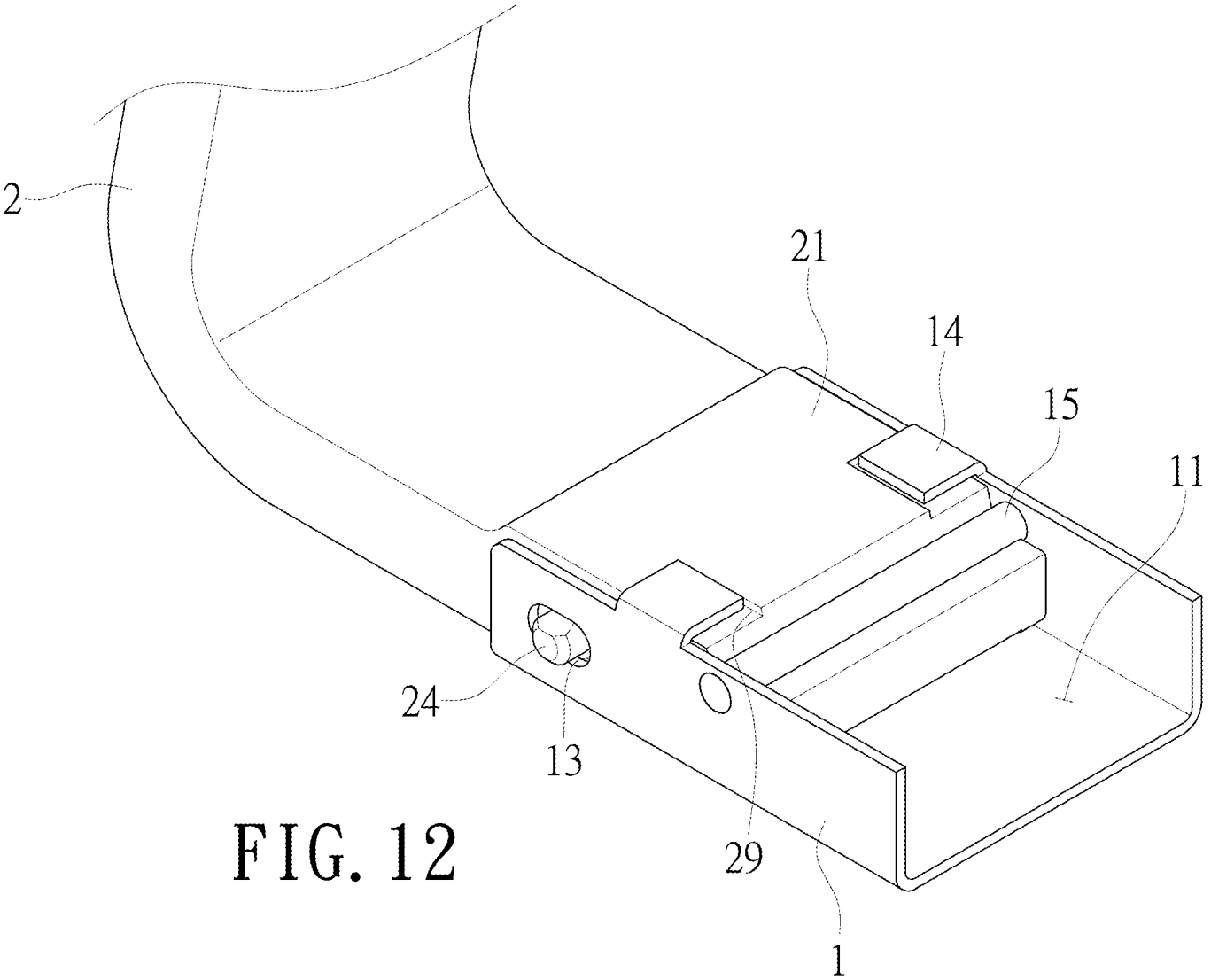
FIG. 12 is another perspective view of an embodiment during assembly according to the present invention.

Furthermore, refer to FIG. 11 and FIG. 12, while the locking bars 24 at the two sides of the connection portion 21 of the back support 2 locked and positioned by the locking holes 13 on the two side walls of the assembly recess 11, the stopping block 14 on the top of each of the two sides of the assembly recess 11 is mounted and positioned in the concave area 29 formed on each of the two sides of the top surface of the connection portion 21 and the leaning rod 15 disposed transversely over the upper part of the assembly recess 11 is abutting against and positioned by the mounting groove 28 transversely on the top surface of the connection portion 21. Thereby the assembly of the seat base 1 with the back support 2 is completed simple and fast. The locking design of the present device can avoid unexpected loosening of the screws used for fastening and connecting the back with the seat now when the users are seated. The design of both the respective stopping blocks 14 on the two sides of the assembly recess 11 mounted in the concave area 29 formed on the two sides of the top surface of the connection portion 21 and the leaning rod 15 of the seat base 1 abutting against and positioned by the mounting groove 28 on the top surface of the connection portion 21 prevent users from falling over while leaning back repeatedly. The safety of the chair is improved while being seated.

Figure 13:
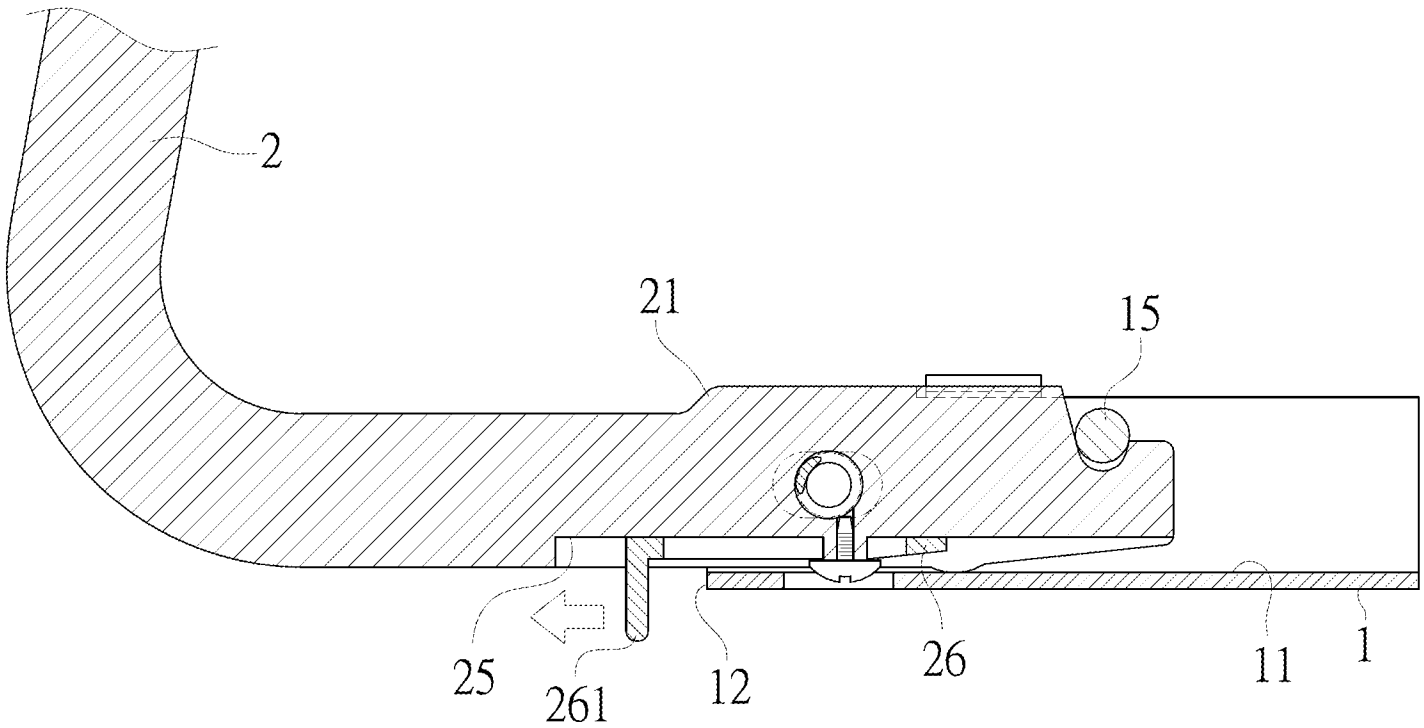
FIG. 13 is a sectional view of an embodiment during disassembly according to the present invention.
Figure 14:
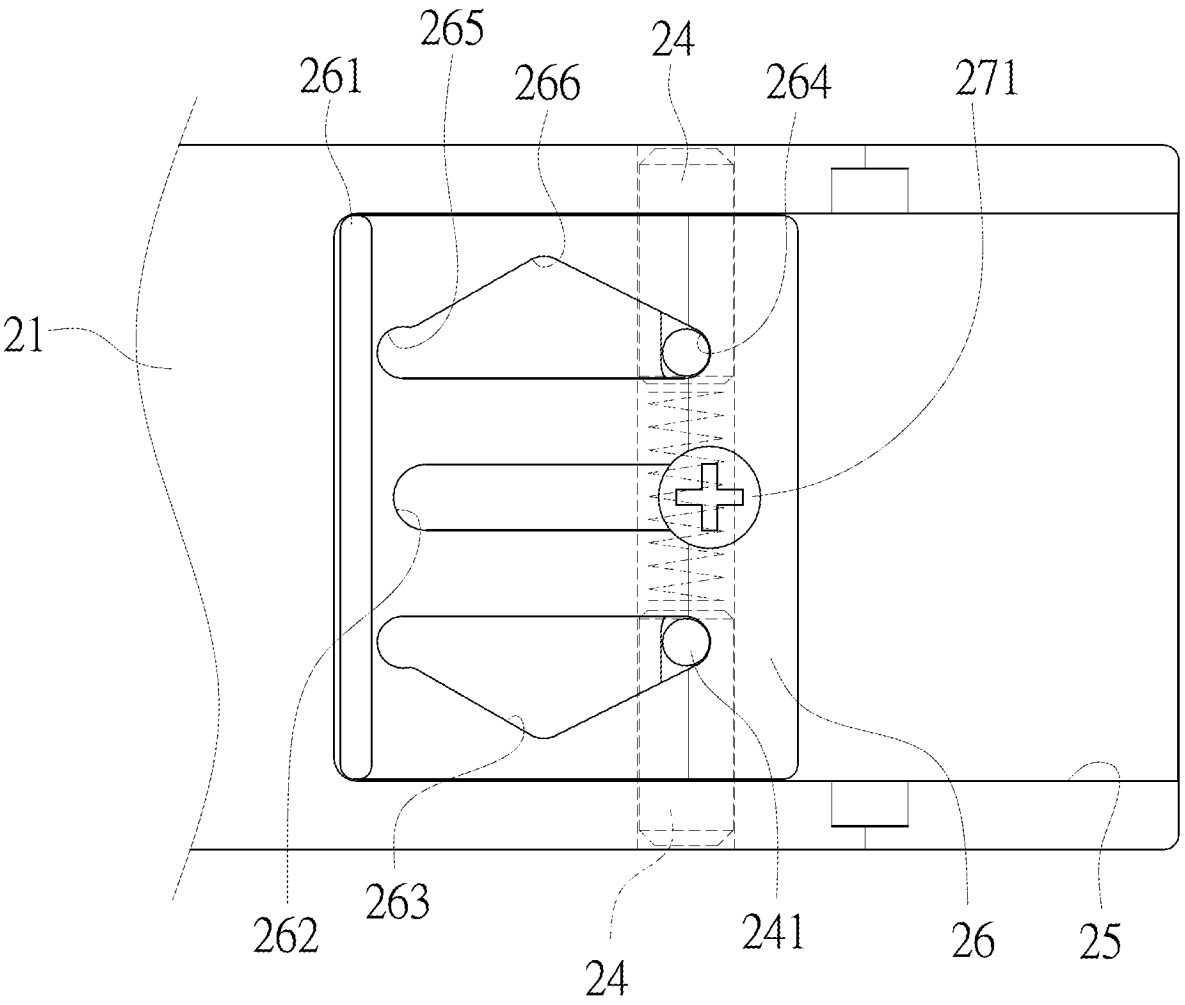
FIG. 14 is a partial bottom view of an embodiment during disassembly according to the present invention.

For the following replacement and maintenance, as shown in FIG. 13 and FIG. 14, the staff hold the pull plate 261 of the driving member 26 on the connection portion 21 of the back support 2 to draw the driving member 26 back. At the moment, the pin 241 of the respective locking bars 24 is moved from the locking-bar release portion 266 toward the first locking-bar binding portion 264 on the front side of the engaging hole 263 of the driving member 26. After reaching the first locking-bar binding portion 264 of the engaging hole 263, the two locking bars 24 are retracted into the mounting holes 22 of the connection portion 21 to release from the state being locked and positioned by the locking holes 13 on two sides of the seat base 1. Thereby the connection portion 21 of the back support 2 is withdrawn and separated from the assembly recess 11 of the seat base 1. Therefore, quick assembly and disassembly are achieved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A chair back and seat assembly comprising:

a seat base which includes an assembly recess, a recess opening formed on one end of the assembly recess, a locking hole arranged at each of two opposite side walls of the assembly recess and the two locking holes corresponding to each other;

a back support which includes a connection portion which is mounted into the assembly recess through the recess opening of the assembly recess of the seat base and provided with a top surface and a bottom surface opposite to each other, a mounting hole transversely penetrating the connection portion, an elastic member mounted in the mounting hole, two locking bars which is mounted in the mounting hole, located at two ends of the elastic member correspondingly, and abutting against the two ends of the elastic member, a guiding slot arranged at the bottom surface of the connection portion and having two transverse guiding holes which are formed on a top of the guiding slot and communicating with the mounting hole, a driving member which is mounted in the guiding slot and including a pull plate, a lengthwise long slot disposed on a middle portion of the driving member, and an engaging hole which is arranged at each of two sides of the long slot, and having a first locking-bar binding portion and a second locking-bar binding portion disposed on two ends of the engaging hole, and a locking-bar release portion located between the first locking-bar binding portion and the second locking-bar binding portion, and a fastener which is inserted through the long slot of the driving member for being fastened with the connection portion and is provided with a head abutting against a bottom surface of the driving member for positioning; wherein the locking bar is provided with a pin formed on a bottom side thereof and projecting from the guiding hole; the pins of the two locking bars are mounted in the engaging holes correspondingly for control of the locking bars to be engaged with or separated from the locking holes on the two opposite side walls of the assembly recess of the seat base by the driving member.

2. The chair back and seat assembly as claimed in claim 1, wherein the locking hole of the seat base is a long slot and a top side of the locking bar on the connection portion of the back support is provided with a cutting surface for guiding the locking bar to be locked and positioned by the long-slot shaped locking hole.

3. The chair back and seat assembly as claimed in claim 1, wherein a stopping block extended from a top of each of the two opposite side walls of the assembly recess toward an inner space of the assembly recess and the two stopping blocks are corresponding to each other; a concave area is formed on each of two sides of the top surface of the connection portion of the back support for mounting and positioning the stopping block on each of the two opposite side walls of the assembly recess.

4. The chair back and seat assembly as claimed in claim 1, wherein a leaning rod is disposed transversely over an upper part of the assembly recess of the seat base and two ends of the leaning rod are connected to the two opposite side walls of the assembly recess correspondingly while a mounting groove is arranged transversely at the top surface of the connection portion of the back support; the leaning rod of the seat base is abutting against and positioned by the mounting groove correspondingly.

5. The chair back and seat assembly as claimed in claim 1, wherein a bump is disposed on the bottom surface of the connection portion of the back support and located at each of two sides of the guiding slot; the bump on the bottom surface of the connection portion is abutting against and positioned on a bottom of the assembly recess of the seat base.

6. The chair back and seat assembly as claimed in claim 5, wherein the bottom surface of the connection portion of the back support is provided with a guiding ramp inclined upward from the bump toward an end of the connection portion.

7. The chair back and seat assembly as claimed in claim 1, wherein a through hole is arranged at a bottom of the assembly recess of the seat base while the head of the fastener of the connection portion of the back support is located in the through hole at the bottom of the assembly recess.

8. The chair back and seat assembly as claimed in claim 1, wherein the engaging hole of the driving member is in a shape of an isosceles triangle having a first end, a second end, and a third end each of which is provided with a rounded corner; the first end and the second end are arranged opposite to each other; the first end and the second end of the engaging hole form the first locking-bar binding portion and the second locking-bar binding portion respectively while the third end of the engaging hole forms the locking-bar release portion.

* * * * *